United States Patent [19]

Ingram et al.

[11] Patent Number: 4,557,208

[45] Date of Patent: Dec. 10, 1985

[54] METHOD AND APPARATUS FOR TUFTING PATTERNED FABRIC

[75] Inventors: Gary L. Ingram, Ooltewah; Ian Slattery, Hixson, both of Tenn.

[73] Assignee: Spencer Wright Industries, Inc., Chattanooga, Tenn.

[21] Appl. No.: 653,290

[22] Filed: Sep. 24, 1984

[51] Int. Cl.[4] ..... D05C 15/00

[52] U.S. Cl. ..... 112/266.2; 112/79 R

[58] Field of Search ..... 112/79 R, 79 FF, 266.2

[56] References Cited

U.S. PATENT DOCUMENTS 3,091,199 5/1963 Ballard ..... 112/79 R 3,100,465 8/1963 Broadrick ..... 112/79 R

*Primary Examiner*—Ronald Feldbaum

*Attorney, Agent, or Firm*—Alan Ruderman

[57] ABSTRACT

A tufting machine has apparatus for feeding the backing material at a first speed for forming tufts having a backstitch of a first length and periodically selectively increasing the feeding rate to a second speed to form tufts having a backstitch of an increased length. The longer backstitch may be a plurality of stitches slightly longer than the first length or a single elongated backstitch. The fabric produced may have a series of tufts projecting from the surface of the backing material in areas having one or more yarn densities and separated by gaps where no tufts project above the surface, the gaps resulting from the elongated backstitches on the reverse side of the material. The apparatus for providing backstitches including the gaps has an intermittent drive which provides an output only during a small portion of the input. A drive shaft is drivingly connected to the feed rollers of the tufting machine and is connected to the input of the intermittent drive through a first one-way clutch and through a second one-way clutch to a driveable member on a control shaft driven by the output of the intermittent clutch. A pattern controlled air operated tooth clutch selectively couples the driveable member to the control shaft. Another pattern controlled air clutch may be utilized to drive the control shaft for providing backstitches slightly longer than the first length.

20 Claims, 11 Drawing Figures

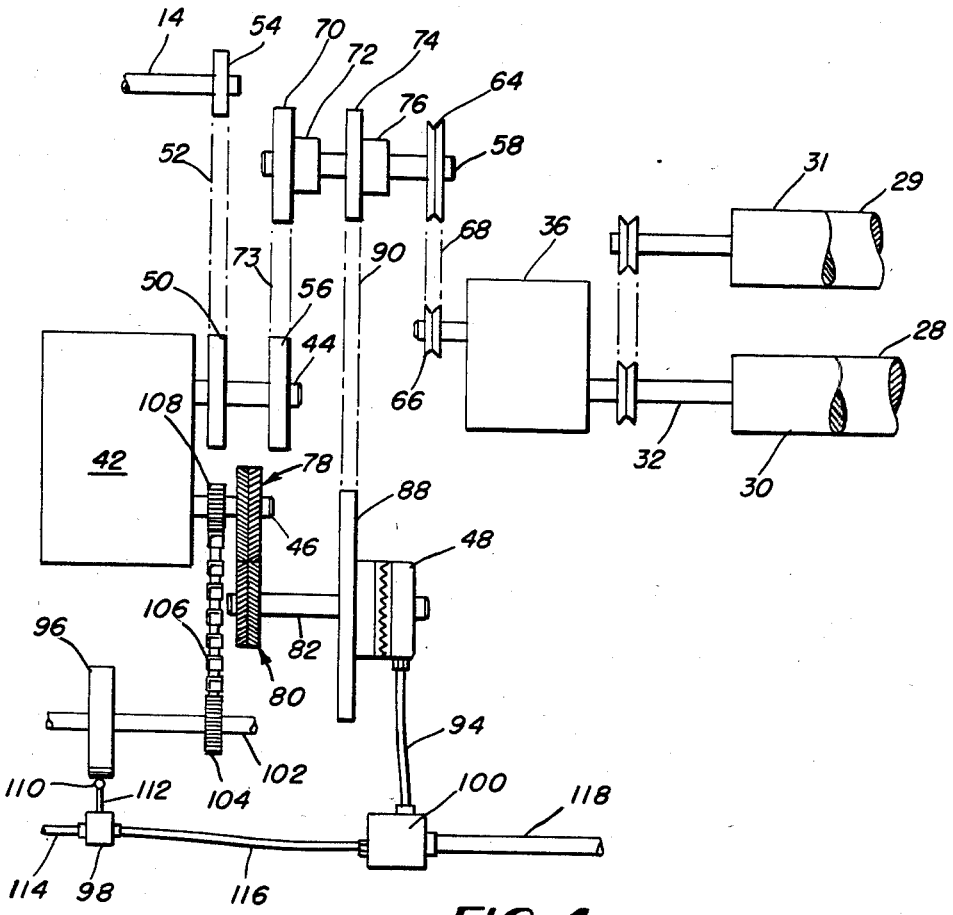
FIG. 4
FIG. 8
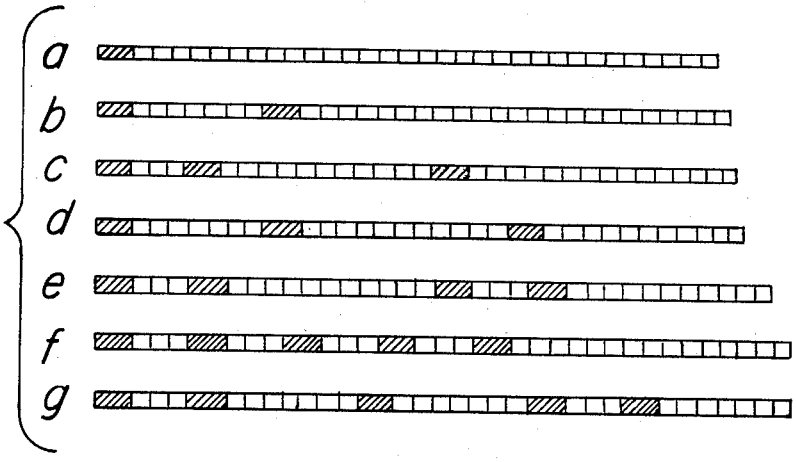

METHOD AND APPARATUS FOR TUFTING PATTERNED FABRIC

BACKGROUND OF THE INVENTION

This invention relates to tufting machines and more particularly to a method and apparatus for producing heretofore unknown patterning effects in the pile fabric produced, such patterning being provided by periodically selectively changing the spacing between tufts in the same longitudinal row of stitching.

In the production of tufted fabrics a plurality of spaced yarn carrying needles extend transversely across the machine and are reciprocated cyclically to penetrate and insert loops of yarn into a backing material fed longitudinally beneath the needles. The loops are seized by loopers or hooks oscillating below the fabric in timed relationship with the needles as the loopers or hooks cross the needles just above the needle eye. In loop pile machines the loopers point in the direction in which the backing material is being fed, hold the seized loops while the needles are being retracted from the backing, and thereafter move away from the point of seizure to release the loop. In cut pile machines the hooks point in the direction opposite to the direction in which the backing material is being fed so the loops feed onto the hooks and each hook cooperates with a respective oscillating knife. Since the loops are being fed toward the closed end of the hook they cannot be released except by being cut by the knife. As the hook rocks away from the point of loop seizure the knife rocks upwardly and cuts the loop. During each penetration of the backing material a row of pile is produced transversely across the backing material. Successive penetrations result in a longitudinal row of pile produced by each needle.

This basic method of tufting limits the aesthetic appearance of tufted fabrics so produced. Thus, the prior art has developed a number of procedures for creating various pattern effects.

One such procedure is to vary the amount of yarn fed to the individual needles selectively. By varying the amount of yarn fed to the individual needles high and low loops can be selectively produced. The most widely used apparatus for producing variations in pile height in tufted fabrics is a yarn feed roller attachment wherein feed rollers are selectively driven at one of a plurality of different speeds controlled by a pattern control. Representative of such feed roller patterning are the disclosures in Card U.S. Pat. No. 2,862,465; Card U.S. Pat. No. 2,966,866; Hammel U.S. Pat. No. 3,103,187; Singleton U.S. Pat. No. 3,489,326; Short U.S. Pat. No. 3,605,660; Hammel U.S. Pat. No. 3,847,098; Lear et al U.S. Pat. No. 3,926,132 and Prichard et al U.S. Pat. No. 3,955,514.

Another procedure for patterning in a tufting machine is to form spaced rows of cut pile and loop pile. A number of methods have been devised to perform this patterning. For example, in Card U.S. Pat. No. 3,084,645; Jolley et al U.S. Pat. No. 4,134,347; Inman U.S. Pat. No. 4,185,569 and Ingram et al U.S. Pat. No. 4,301,752 cut pile and loop pile may be formed selectively in the same row of stitching by various means such as back robbing yarn to move a spring clip away from a hook which has seized a loop of yarn, the loops withdrawn remaining uncut while those not withdrawn are cut by a knife acting in conjuntion with the hook. In others of these patents level cut pile and loop pile may be formed in the same row of stitching by controllably moving a gate which opens and closes passage of a loop onto the hook. In Card et al U.S. Pat. No. 3,919,953 adjacent rows of loopers and hooks point in the opposite direction to each other to form alternate rows of cut pile and loop pile.

Another procedure for pattterning is to initiate relative lateral movement between the backing material and the needles to laterally displace longitudinal rows of stitching. One method is to jog or shift the needle bar transversely across the tufting machine relative to the base material in a step-wise manner in accordance with a pattern. Bryant et al U.S. Pat. No. 3,026,830; Smith U.S. Pat. No. 3,964,408; Smith U.S. Pat. No. 3,972,295; Webb U.S. Pat. No. 4,010,700; Schmidt et al U.S. Pat. No. 4,173,193; and Ingram U.S. Pat. No. 4,392,440 are exemplary of this prior art. Another method of initiating such relative movement is by jogging or shifting the needle plate which effects movememt of the backing material. Exemplary of this prior art are Card U.S. Pat. No. 3,301,205; Watkins U.S. Pat. No. 3,577,943; Smith U.S. Pat. No. 3,934,524 and Ingram et al U.S. Pat. No. 3,964,407. A third method of initiating such relative lateral shifting is by use of what is known as a "jute shifter" whereby the backing material is shifted by a spike roller laterally of the tufting machine.

The great popularity of tufted broadloom carpeting has, in fact, been due to these various patterning developments. At one time woven broadloom accounted for substantially all of the carpeting produced, and due to the nature of that process the goods were expensive and affordable only to a relatively few. Today because of the developments in the tufting art, tufted broadloom accounts for approximately 95% of the market, and because of the faster production rates and lesser amounts of yarn required, tufted carpeting is readily available to the great mass of the population. Recently, tufting has made inroads into the upholstery field with developments in very fine gauge tufting machines and with the ability to form very low pile. However, the typical broadloom patterns are not generally appealable aesthetically for upholstery fabric and weaving is still by far the major process for producing such goods.

SUMMARY OF THE INVENTION

The present invention provides tufted fabric and a method and apparatus for producing the fabric in a tufting machine, the fabric having a backstitch formed in the backing material which is selectively elongated according to a pattern, the elongation occuring by periodically selectively increasing the speed at which the backing material is fed through the tufting machine as determined by the pattern. The term "pattern" as hereinafter used is defined as that predetermined array of stitches in which various elongated stitches may selectively occur, and such elongated stitches may occur periodically in a fixed repeat or may be omitted selectively from the repeat.

Consequently, it is a primary object of the present invention to provide a patterned tufted fabric and a method and apparatus for producing the same, the fabric being adaptable for upholstery, broadloom, rugs, wall coverings and the like.

It is another object of the present invention to provide a tufted fabric having an elongated backstitch periodically selectively formed in the same longitudinal row of stitching as a plurality of shorter backstitches, and a method and apparatus for tufting the fabric.

It is a further object of the present invention to provide a method and apparatus for feeding a backing material longitudinally through a tufting machine and periodically increasing the feeding rate selectively to increase the length of the backstitch produced in the backing material.

It is a still further object of the present invention to provide a method and apparatus for tufting such that a fabric simulating wovens may be produced in a tufting machine, the method and apparatus comprising feeding the fabric longitudinally through the tufting machine at a first speed while forming tufted pile in the fabric having a backstitch of a first length, and periodically increasing the feed rate to a second speed selectively while forming tufted pile in the fabric having a longer backstitch than said first backstitch.

It is a yet still further object of the present invention to provide apparatus in a tufting machine for periodically increasing the rotational speed of the backing fabric feed rollers, said apparatus including an intermittent drive having an input shaft and an output shaft, the output shaft being driven only during a portion of the rotation of the input shaft, an input drive train and an output drive train, the input shaft being operatively connected to the input drive train and the output shaft being operatively connected to the output drive train, means for selectively coupling the input drive train to the feed rollers for normally driving the feed rollers at the first speed when the output shaft is not driven, and means for selectively uncoupling the feed rollers from the input drive train and for coupling the output drive train to the feed rollers for driving the feed rollers at the second speed when the output shaft is driven.

It is yet a still further object of the present invention to provide apparatus in a tufting machine for periodically increasing the rotational speed of the backing fabric feed rollers, said apparatus including an intermittent drive which provides an output only during a small portion of the input, the input being operatively connected to the feed rollers and driveable therewith as the feed rollers rotate at a selective first speed, a driveable member associated with the output of the intermittent drive to be selectively driven thereby as determined by a pattern, and means for operatively connecting the driveable member to the feed rollers when the driveable member is driven and for disconnecting the feed rollers from the operative connection with the input so as to drive the feed rollers at a second speed.

Accordingly, the present invention provides apparatus for a tufting machine, a method of tufting a patterned fabric and the fabric produced thereby, the fabric having a series of tufts projecting from the surface of the backing material equally spaced apart and separated by transition areas where the tufts are spaced apart differently or where no tufts project above the backing material surface. By selective threading of the various needles of the tufting machine, pattern variations may be produced such that the fabric may simulate a woven fabric. Those transition areas where the tufts do not project above the backing material surface are effected by a substantially elongated backstitch on the reverse side of the fabric relative to shorter backstitches separating the other tufts. These elongated backstitches may be selectively disposed in the fabric as predetermined by a pattern in accordance with the method of the present invention.

Broadly, the method of the present invention comprises feeding a backing material through a tufting machine and inserting yarn carrying needles through the backing material to form successive series of tufts, whether loop pile or cut pile, and periodically selectively increasing the speed at which the backing material is fed through the tufting machine to form tufts having an elongated backstitch between adjacent tufts. Certain, if not all, of the elongated backstitches may be either a number of slightly elongated stitches or a single substantially elongated stitch or a combination thereof.

In carrying out the invention the tufting machine includes apparatus for feeding the backing material at a first speed through the machine for forming tufts having a backstitch of a first length and periodically selectively increasing the feeding rate to a second speed to form tufts having a backstitch of an increased length.

One aspect of the invention is to form a single elongated backstitch, and the apparatus includes an intermittent or index drive which provides an output during a small portion of the input cycle. The input to the intermittent drive is driveably coupled to the feed rollers for driving the feed rollers at the first speed. A driveable member is associated with the output of the intermittent drive and may be selectively coupled to and driven thereby. Coupling members selectively couple the driveable member to the output of the intermittent drive and to the feed rollers and uncouple the feed rollers from the driveable coupling with the input to the intermittent drive for driving the feed rollers at the second speed. The driveable member may be driveably coupled to the output of the intermittent drive at all times so as to produce one elongated backstitch for a number of smaller backstitches as determined by the ratio of the time the output of the intermittent drive is driven relative to the input, or the driveable member may be selectively coupled to the output of the intermittent drive in accordance with a pattern to eliminate selected elongated stitches.

In the preferred form of this aspect of the invention the index drive has a 4 to 1 ratio so that for 360° input to the index drive the output occurs during 90°. Thus, every fourth stitch may be elongated or a pattern control may be utilized to eliminate the output coupling to the feed rollers during certain of the fourth stitches so that the smaller backstitch may occur during those times. In this manner an elongated backstitch may be made either every fourth stitch, every eighth stitch, every twelfth stitch, every sixteenth stitch etc., or selected combinations thereof. The length of the elongated stitch relative to the length of the other stitches may be selected by proper selection of various motion transmitting members in the drive train from the output of the intermittent drive to the feed rollers.

Consequently, the number of elongated stitches and the length of the elongated stitches may be chosen in accordance with a desired aesthetically appealing pattern in the fabric, and such fabrics may simulate woven fabrics not heretofore provided by the tufting process.

In the specific form of the first aspect of the invention the input to the intermittent drive is coupled to the feed rollers through drive members including a one-way clutch which normally couples the drive members to the feed rollers. The output of the intermittent drive is coupled to the feed rollers through drive members including a second one-way clutch which normally slips and is uncoupled from the feed rollers as the feed rollers are rotated at the slower speed. When the output of the intermittent drive is coupled to the drive members associated with the second one-way clutch this clutch is coupled to the feed rollers at the higher speed and the first one-way clutch slips and is uncoupled from the feed rollers. A third clutch may be utilized and engaged in accordance with a pattern to selectively couple the output of the intermittent drive to the drive members associated with the second one-way clutch. The third clutch may be a pneumatically actuated clutch with the air supply thereto controlled in accordance with a pattern.

A second aspect of the invention is to provide sets of slightly elongated stitches selectively formed by increasing the feed rate for a selected period. The apparatus includes at least two different speed motion transmitting members which are selectively coupled to and uncoupled from the feed rollers to drive the feed rollers at the various speeds selectively determined by a pattern. In the preferred form of this aspect of the invention a one-way clutch normally couples a first speed motion transmitting member to the feed rollers, and a higher speed motion transmitting member includes a pattern controlled clutch which overrides the one-way clutch to drive the feed rollers at the higher speed.

A third aspect of the invention combines the first and second aspects so that not only may a plurality of first and second stitches of different length be formed in the backing fabric, but also a single stitch elongated relative to the first and second stitches may be periodically selectively inserted to obtain a gap or spaced transition area in the fabric. The apparatus for providing the preferred two stitch rate tufts and the single substantially elongated stitch comprises a combination of the apparatus so far described. Thus, a first motion transmitting member is normally coupled to the feed rollers and this can be overridden by a pattern controlled clutch to drive the feed rollers at a higher second speed, and both of these may be overridden by a third and yet higher speed drive including an intermittent or index drive.

BRIEF DESCRIPTION OF THE DRAWINGS

The particular features and advantages of the invention as well as other objects will become apparent from the following description taken in connection with the accompanying drawings, in which:

FIG. 4 is a diagrammatic view of the apparatus of FIG. 1 including the stitch control pattern means;

FIG. 8 is a diagrammatic presentation of a number of possible patterns having a 32 stitch repeat and utilizing a 4 to 1 index drive.

DESCRIPTION OF THE PREFERRED EMBODIMENT

Figure 1:
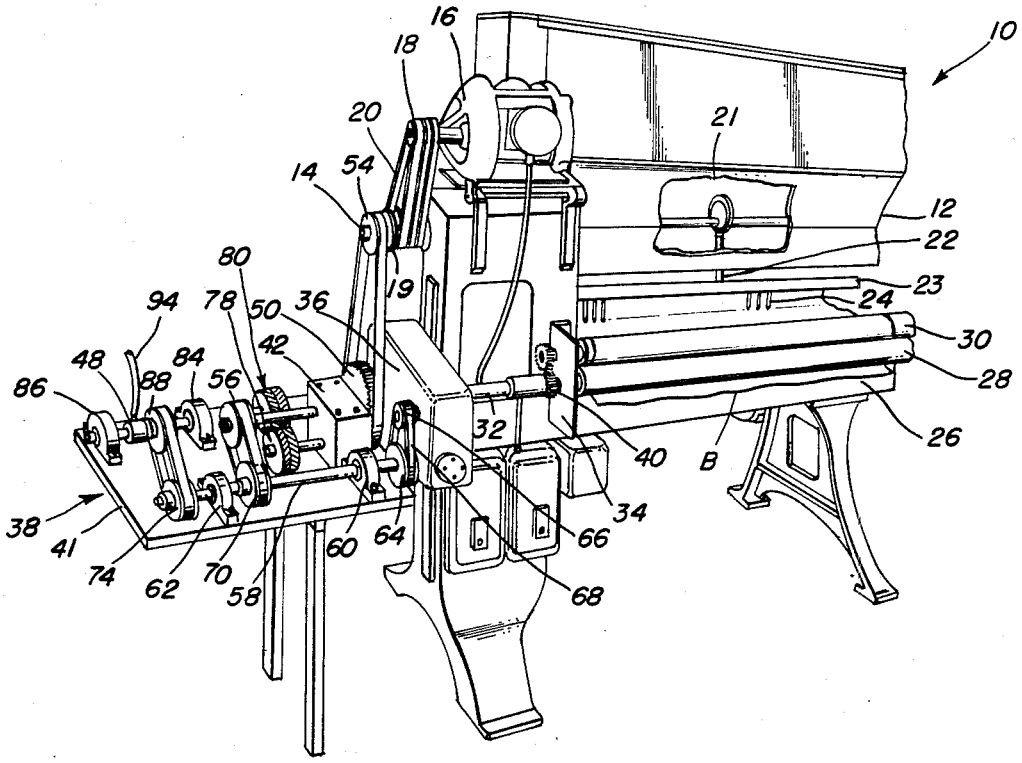
FIG. 1 is a fragmentary perspective view of a tufting machine incorporating backing material feed control apparatus constructed in accordance with a first aspect of the principles of the present invention.

Referring now to the accompanying drawings, FIG. 1 illustrates a portion of a tufting machine 10 incorporating apparatus constructed in accordance with a first aspect of the invention. The tufting machine includes a head 12 within which a main drive shaft 14 is journally mounted and which extends out at least one end thereof. The drive shaft 14 is driven by a motor 16 mounted on the frame of the machine and drivingly connected to the extending portion of the drive shaft by conventional means such as pulleys 18, 19 and belts 20. Mounted on the main drive shaft 14 within the head 12 of the machine are a plurality of eccentrics 21, only one of which is illustrated each of which is drivingly connected in conventional manner through push rods 22 to a needle bar 23 which carries a plurality of yarn-carrying needles 24 defining at least one needle bank substantially aligned transversely across the machine. Upon rotation of the main shaft 14, endwise reciprocation is imparted to the needles for penetrating a backing material B and projecting loops of yarn therethrough.

As is notoriously well known in the art, beneath the head 12 the frame of the machine includes a bed 26 which carries a needle plate (not illustrated) over which the backing material B is fed and beneath which oscilatory hooks or loopers are adapted to cooperate individually with a respective one of the needles 24 to seize the loops formed by the needles in conventional manner and to either form loop pile or to cut the loops seized by the hooks to form cut pile. Both cut pile and loop pile in the same row of stitching may be selectively formed in a manner disclosed in Card U.S. Pat. No. 3,084,645.

The backing material feeding mechanism includes a pair of rear feed rollers 28, 30, the feed roller 28 being a spike roller mounted on a shaft 32 journalled in brackets 34 at each end of the machine (only one of which is illustrated) and may be driven from a transmission box 36 attached to the frame of the machine. Conventionally the transmission box would generally be driven directly from the main shaft by means of pulleys and belts or the like. However, in accordance with the principles of the present invention the input to the transmission box is driven by apparatus indicated generally at 38 hereinafter described in detail. The feed guide roller 30 may be driven from the shaft 32 by means of a pair of inter-meshing gears 40. A pair of front feed rollers 29, 31 (illustrated in FIG. 4) may be positioned at the front of the machine to guide the backing material as it is being pulled through the machine by the rear feed rollers and preferrably is driven in timed relationship with the rear feed rollers.

In accordance with the principles of the first aspect of the present invention the feed rollers 28, 30 are driven at a first feeding rate and then selectively in a controlled manner at a second feeding rate so as to increase the length of the backstitch produced in the backing material. To drive the feed rollers in this manner the apparatus 38, which may be mounted on a supporting frame 41, attached to or supported adjacent the machine, includes means for rotating the shaft 32 at different speeds selectively. To do this a first speed drive means is placed in coupled relationship to the shaft 32 and periodically and selectively is uncoupled from the driving relationship and a second speed drive means is placed in coupled relationship to drive the shaft 32 at a faster speed. If a relatively large number of elongated stitches are desired to be periodically sewn into the backing material this can occur by coupling a driving shaft onto one or more shafts each rotating at a different speed and driving the shaft 32 from the driving shaft in a manner similar to that in use for yarn feed roller attachments such as the aforesaid Singleton U.S. Pat. No. 3,489,326. In such yarn feed systems face clutches are used which tend to slip, the slippage increasing with use, thereby resulting in variations in the amount of yarn fed. Such small variations are hardly noticable in the pile height of the fabric produced. This provides reasonable results in a fabric feed system constructed in accordance with the second aspect of the present invention where a large number of stitches of a first stitch length are to be sewn adjacent another large number of stitches at a second stitch length, but such an arrangement would not give the consistency required for a backing material feed system where an elongated backstitch is desired for effecting a controlled gap on the face of the fabric produced. Here any variation in the length of the elongated stitch would be readily seen on the face of the fabric and would fall far short of the woven products to be simulated. Consequently, the apparatus 38 of the first aspect of the present invention includes positive clutching elements which ensure consistency.

Figure 2:
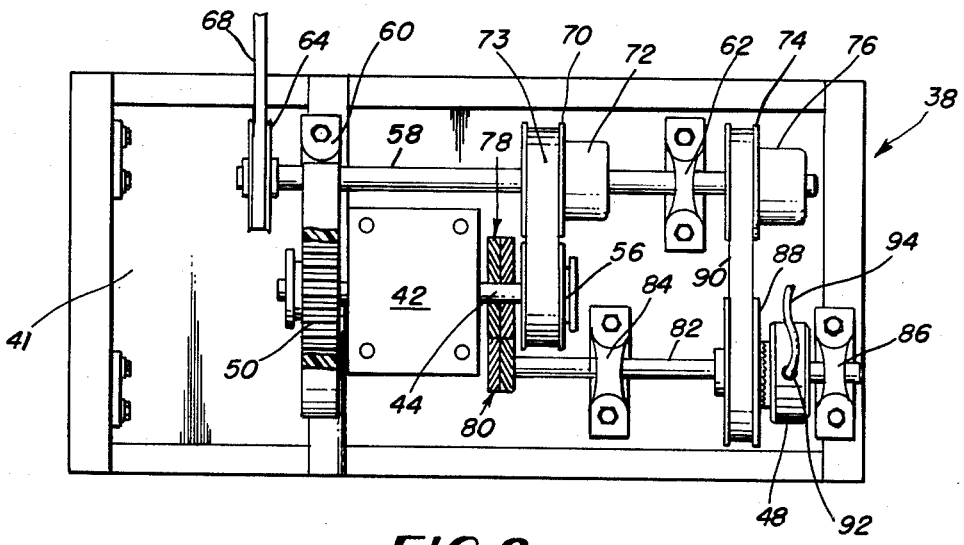
FIG. 2 is a top plan view of the backing feed control apparatus illustrated in FIG. 1.
Figure 3:
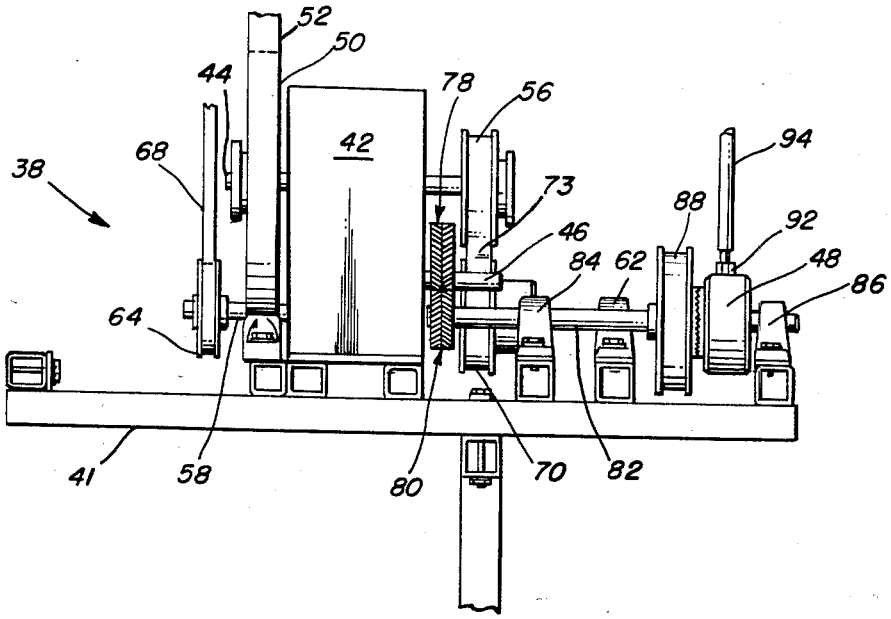
FIG. 3 is a side elevational view thereof.

To this end the apparatus 38, as best illustrated in FIGS. 2 and 3, comprises an intermittent drive 42 which is an indexing device which converts continuous rotary motion at an input shaft 44 to intermittent rotary motion at an output shaft 46. Any number of available index devices for converting continuous rotary motion at the input shaft into intermittent rotary motion at the output shaft may be utilized as the indexing device. For example, a Ferguson model P 5-4 FM 150-120 or a Camco parallel drive model 1200-P 4H 96-120 may be utilized. The Ferguson type drive is disclosed in U.S. Pat. No. 3,572,173 while the Camco drive is manufactured by Emerson Electric Co. of Chicago, Ill. Such drives generally have a cam on the input shaft and a follower on the output shaft, the cam having a dwell portion. With an index device such as the aforesaid Ferguson and Camco models the output shaft makes ¼ of a revolution for each full revolution of the input, and is thus considered to be a four stop box. Thus, the output of the index device provides a 90° output rotation for every 360° rotation of the input shaft 44. It will be evident that particular applications of the apparatus may require different ratios of input to output to satisfy the patterning requirements for particular applications. A positively acting clutch such as a tooth clutch 48 may couple the motion derived from the output shaft 46 to drive the feed rollers as now to be described, the clutching occuring during a portion of the time in which the output shaft 46 is stationary so as to avoid breakage of the teeth of the clutch. The positive action of the tooth clutch ensures that a single elongated stitch may be produced as desired.

The input shaft 44 of the aforesaid index drive may be modified so as to extend from both ends of the index drive as illustrated in FIGS. 2 and 3 or a model may be purchased having such an input shaft. This provides a more convenient arrangement so that motion transmitting elements may be mounted on each end of the shaft however, in FIG. 4 the input shaft 44 is illustrated as extending from only one end. Thus, in FIGS. 1–3, securely mounted on one end of the shaft 44 is a gear pulley 50 and a gearbelt 52 is trained about this pulley and a gear pulley 54 mounted on the mainshaft 14 so that the input shaft 44 is driven in timed relationship to the mainshaft and thus the needles. Because the output of the index drive 42 makes ¼ of a turn for one revolution of the input shaft and since this ¼ of a turn should occur during one revolution of the mainshaft, the ratio of the pulley 50 and 44 should be 1 to 4 so that the input shaft revolves ¼ of a turn for each revolution of the mainshaft. Mounted fast on the other end of the input shaft 44 is another gear pulley 56.

Spaced from the input shaft 44 of the index drive 42 is a controllably driven shaft 58 journally mounted in bearing blocks 60, 62. Fast on one end of the shaft 58 is a pulley 64 which drives a pulley 66 by means of belt 68, the pulley 66 being mounted on the input shaft to the transmission box 36. Of course, the shaft 58 may be directly coupled to the transmission box 36 if desired. Also mounted on the shaft 58 is a gear pulley 70 and a one-way clutch 72. The one-way clutch 72 is a conventional device having an inner member fastened to the shaft 58 and an outer member which is secured to the gear pulley 70. The gear pulley 70 is journally carried on the shaft 58 and a gear belt 73 is trained about it and the gear pulley 56. The belt 73 drives the pulley 70 from the input shaft pulley 56 and the outer member of the one-way clutch in the direction normally to drive the inner member and thus the shaft 58. The rotation of the shaft 58 is then transmitted to the feed rollers 26, 30 to feed the backing at a normal or first feed. As hereinafter described when the shaft 58 is rotated at a higher speed than that determined by the pulleys 56, 70, the relative motions between the inner and outer members of the one-way clutch are such that the clutch slips and the pulley 70 merely free-wheels. Thus, when the speed of the shaft 58 is periodically and selectively increased to drive the feed rollers 28, 30 at a higher speed than the first speed the pulley 70 freely rotates relative to the shaft 58 with no driving relationship therebetween.

A second gear pulley 74 is journally mounted on the shaft 58 and a second one-way clutch 76 is also mounted on the shaft 58, the pulley 74 being substantially identical to the pulley 70 and the one-way clutch 76 being substantially identical to the one-way clutch 72 and secured to the pulley 74 in the same manner that the one-way clutch 72 is secured to the pulley 70. The one-way clutches 72 and 76 may be of a type similar to the Formsprag Model 500 manufactured by Formsprag Division of Dana Corporation of Warren, Mich. Periodically and selectively as hereinafter described the pulley 74 is driven at a higher speed than the first speed of the shaft 58 to drive the one-way clutch 76 and thus the shaft 58 at the higher speed. At all other times the relative rotation of the inner member to the outer member of the one-way clutch 76 is such that the outer member and thus the pulley 74 free-wheels.

Mounted on the output shaft 46 of the index drive 42 is a gear asssembly 78 which may comprise a pair of helical gears back-to-back to form a herringbone gear arrangement. The gear assembly 78 is in mesh with and drives a similar but smaller gear assembly 80 mounted on a control shaft 82 journalled in spaced bearings 84, 86. The gear ratio of the gear assemblies 78 and 80 may be selected as desired for obtaining the nominal elongated stitch length relative to the normal stitch length, and has been initially selected as 2 to 1 since stitch length ratios in this range appear desirable, and as hereinafter will be made clear the exact stitch length ratio may be selected by other means.

Mounted on the control shaft 82 is the tooth clutch 48 which is a conventional item. Such clutches have one part fast on the shaft 82 and a second part rotatable with the first part and axially moveable on and relative to the first part for engaging with a third part, the third part being rotatable relative to the first and second part until engaged. The second and third parts have cooperating engagable teeth, and the second part is moveable on splines or the like on the first part so as to engage and couple with the third part or to disengage and uncouple therefrom. When the teeth are engaged the three parts rotate as a unit with the shaft 82, and when disengaged the third part is not driven but free-wheels while the first and second parts are rotated. Fastened on and rotatable with the third part of the clutch 48 is a gear pulley 88, and a gearbelt 90 is trained about this pulley and the pulley 74. The size and thus the drive ratio between the pulleys 74 and 80 together with the gear ratios of the gear assemblies 78, 80 determines the speed at which the shaft 58 will be driven when the pulley 88 is coupled and driven by the shaft 82 by means of the clutch 48. Thus, the exact ratio of the length of the elongated stitch relative to the normal stitch may be selected by selection of the pulleys 74, 88.

It should be understood that if the pulley 88 is always to be coupled to the shaft 82 there is no need to have the clutch 48 but in that case one elongated stitch will occur periodically every time the output shaft 46 of the index drive is rotated. The higher second speed transmitted from the pulley 88 to the pulley 74 results in the one-way clutch 76 drivingly engaging the shaft 58 and results in the one-way clutch 72 disengaging therefrom. Thus, the higher second speed is transmitted to the backing material drive rollers and the spacing between successive needle penetrations in each longitudinal row is longer than the spacing when the backing material is driven at the first speed by means of the pulleys 56, 70. Thus, if the pulley 88 is always coupled to the shaft 82 every fourth stitch produced using a 4 to 1 index drive will thus always be elongated and the pattern made by each needle will always be three short stitches and one long stitch. If an index drive having a different index time were used, such as a six stop drive, then every sixth stitch would be elongated and there would be five short stitches and one long stitch. Although such a construction may be desirable under certain circumstances, and is considered to be part of the present invention, it would lack the flexibility to produce pattern variations. Thus, the clutch 48 is utilized, and it is preferred that the clutch be actuated by a control signal in accordance with a pattern. Then every time the control shaft 82 is rotated while the clutch 48 is engaged the feed rollers will increase in speed, but if the clutch is not engaged the pulley 88 will merely free-wheel and stitches of normal or first length will be formed.

Although an electrically actuated clutch could be utilized to selectively couple the pulley 88 to the shaft 82, it is preferred to use an air operated clutch such as the 5H or 5H(P) series tooth clutches manufactured by Horton Manufacturing Co., Inc. of Minneapolis, Minn. The clutch 48 thus includes an air control port 92 to which air is fed through a conduit 94, the air being controllably supplied in accordance with a pattern. Although a number of pattern control devices may readily be envisioned to control the clutch 48, the preferred control means, as illustrated diagrammatically in FIG. 4, comprises a control cam 96 driven from the output shaft of the index drive for actuating a small control valve 98, the latter controlling a larger air valve 100 which opens and closes communication of a main air supply to the clutch 48. Thus, the cam 96 may be mounted on a shaft 102 having a sprocket 104 driven by a chain 106 from a sprocket 108 mounted on the output shaft of the index drive 42. The cam 96 may have any number of lobes of varying length on the periphery thereof which determines whether the clutch 48 is engaged to form an elongated stitch every fourth stitch (for a 4 stop box) or not engage so that a stitch of the normal length is formed at that time.

The peripheral surface of the cam 96 acts against a roller follower 110 mounted on a stem 112 extending from the control valve 98. The control valve is a pilot valve and may be a Mead model MV-25 manufactured by Mead Fluid Dynamics Company of Chicago, Ill. which comes complete with the roller follower 110. A valve of this type is disclosed in U.S. Pat. No. 3,229,721. Air is supplied to the control valve 98 through a line 114 and, as determined by the cam 96, communicates the air or shuts the air flow through the outlet of the valve 98 to a control air line 116. The larger air valve 100 which may be a model 20-12 manufactured oy Clippard Manufacturing Co. of Cincinnati, Ohio, receives air from a main air supply conduit 118 and either communicates it to the clutch 48 or shuts off the flow as determined by the control air supply line 116. When the air flows to the clutch 48 it couples the gear pulley 88 to the shaft 82. The clutch, if it is to be engaged, is actuated when the shaft is not rotating so as to preclude breakage of the teeth of the clutch. Thus, the clutch is preferred to be actuated for the next cycle, if called upon by the cam 96, just as the output shaft 46 stops its rotation from the previous cycle. If the clutch is to be engaged for successive cycles, the cam maintains the air flow to the clutch 48 and the clutch remains engaged for the successive cycles. Consequently, with a 4 to 1 ratio index drive when the clutch is to be actuated it does so while the shaft 46 is not rotating and well in advance of the time at which the elongated stitch is to be sewn into the backing material.

Figure 5:
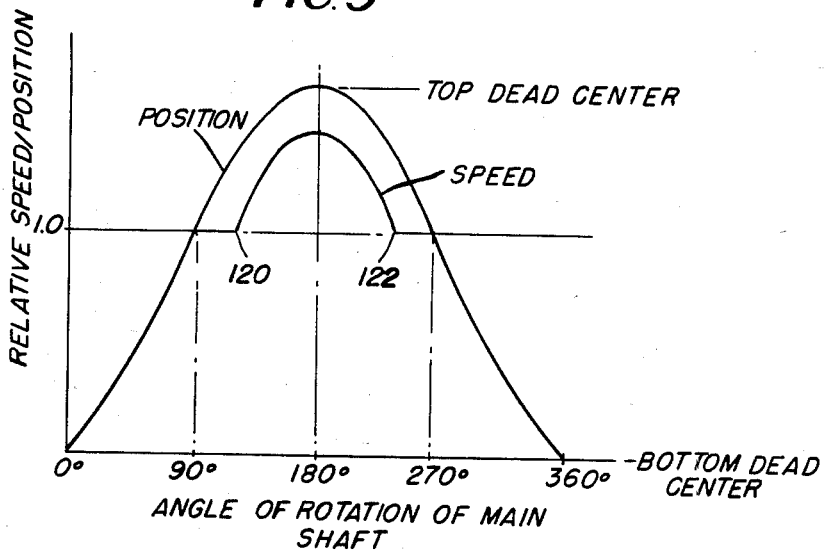
FIG. 5 is a graphical presentation of that cycle of the tufting machine during which the backing material feed is increased.

The timing of the speed increasing cycle, as illustrated in FIG. 5, is such that the shaft 58 and thus the speed rollers 28, 30 increase in speed during approximately $\frac{1}{4}$ of a revolution of the mainshaft 14. The increase in speed follows a substantially simple harmonic motion or sine curve from the initial point 120 at which the one-way clutch 76 begins to drive to the point 122 at which it no longer drives. These two points should occur while the needles are outside the base material, and ideally the needles are at top dead center when the clutch 76 and thus the shaft 58 are at maximum speed. The curve denoted SPEED represents the speed of the shaft 58 while the curve denoted POSITION denotes the position of the needles, both being relative to the cycle of the mainshaft 14 during a cycle in which the speed of the feed rollers is increased. Thus, the speed is constant at the first or normal speed indicated by the relative speed 1.0 at the ordinate of the graph and the stitch rate is constant until preferably a little more than approximately 90° of the cycle at which time the needles have exited from the backing and the speed increases as the needles ascend until the needles are at top dead center. The speed thereafter begins to decrease as the needles descend and is again at the low constant speed when the needles penetrate the backing. If the clutch 48 is not engaged, the speed will remain at the first speed.

Figure 6:
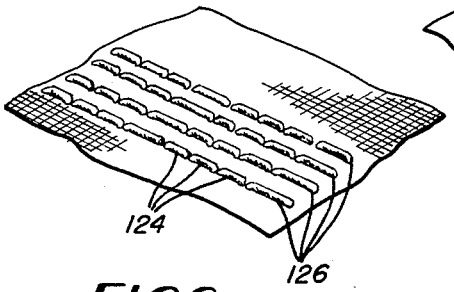
FIG. 6 is a diagrammatic view of one possible tufted pattern formed in accordance with the principles of the first aspect of the invention, the array illustrated being made by four needles.
Figure 7:
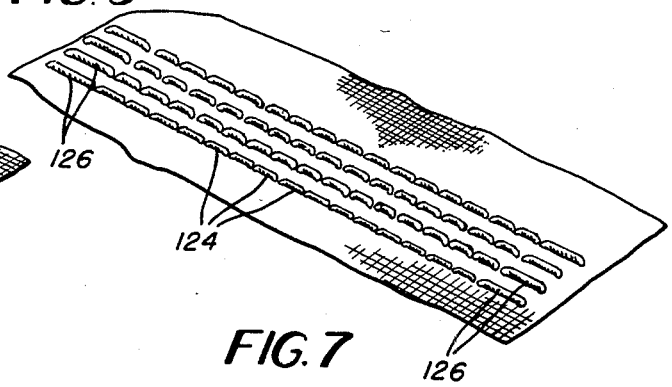
FIG. 7 is a view similar to FIG. 6 but of another possible pattern array.

Referring now to FIGS. 6 and 7 it may be seen that with a 4 to 1 index drive 42 each threaded needle will make three short stitches 124 and one elongated stitch 126 each cycle if the clutch 48 is always engaged, as illustrated in FIG. 6. If, however, the cam 96 is such that the clutch 48 is not actuated for three cycles after the formation of each elongated stitch, then each needle will form a pattern having 15 short stitches 124 and one elongated stitch 126 as illustrated in FIG. 7. Since the face of the fabric will have a space every time an elongated stitch is formed, and since the length of the space will depend upon the length of the elongated stitch, the space is determined by the drive ratios of the gears 78, 80 and the pulleys 74, 88. Moreover, by not threading particular needles which are spaced apart by the same spacing between elongated stitches, a pattern can be formed by the fabric having squares separated longitudinally by spaces resulting from the elongated stitches and separated laterally by spaces resulting from the unthreaded needles. Such a fabric closely simulates a particular woven fabric not heretofore producable by a tufting machine.

Furthermore, a multitude of pattern variations may be produced by the apparatus disclosed merely by variations in the design of the cam 96. Some of these possible pattern variations are illustrated diagrammatically in FIG. 8 using a cam having a 32 stitch repeat and the 4 to 1 index drive. The variations in the patterns are effected by not engaging the clutch 48 during certain selected fourth stitches. Thus, periodically in four stitch sequences an elongated stitch may or may not be formed, as selectively determined by the pattern cam 96. These sequences are merely representations of the possibilities with the stated design perimeters. Thus, in FIG. 8(*a*) there is 1 elongated stitch and 31 short stitches, while in FIG. 8(*b*) there is an array of 1 elongated stitch then 7 short stitches, another elongated stitch and 23 short stitches. In FIG. 8(*c*) the array is 1-3-1-11-1-15; in FIG. 8(*d*) it is 1-7-1-11-1-11; in FIG. 8(*e*) it is a 1-3-1-11 repeat; in FIG. 8(*f*) the repeat is 1-3-1-3-1-3-1-3-1-15; and in FIG. 8(*g*) the repeat is 1-3-1-7-1-7-1-3-1-7. By using an index box of an "x" stop design, periodically in "x" stitch sequences an elongated stitch may be selectively inserted or omitted. For example, a 6 stop index box may have a 1–5 repeat or deletion of the elongation stitch on certain selected sixth stitches.

Figure 9:
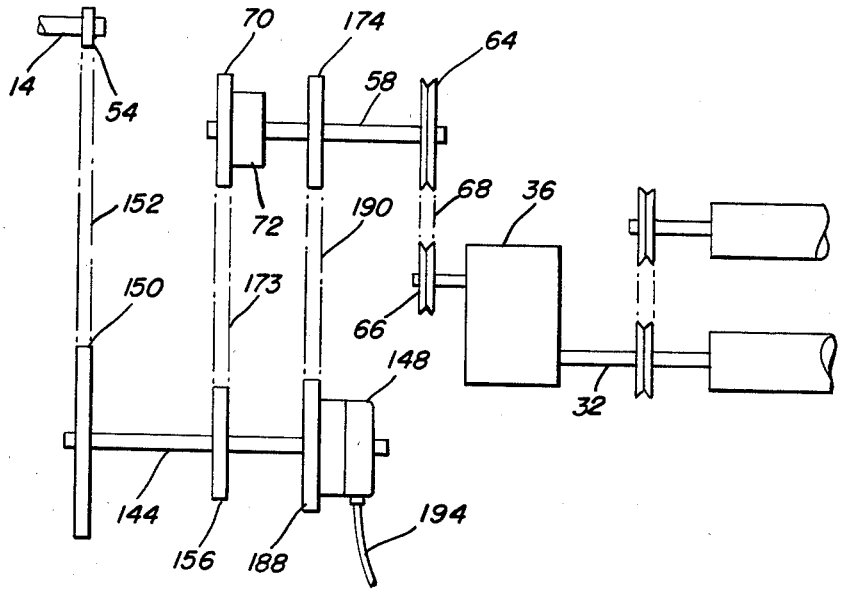
FIG. 9 is a diagrammatic view similar to that of FIG. 4, but illustrating a second aspect of the invention.

Referring to FIG. 9 a second aspect of the invention is to drive the feed rollers at a first or a second speed selectively to vary the number of stitches inserted into the backing material in accordance with a pattern. To this end a gear pulley 150 may be mounted fast on a shaft 144 and driven by a gear belt 152 trained about the pulley 150 and about the gear pulley 54 mounted on the mainshaft 14 to drive the shaft 144. Another gear pulley 156 is mounted fast on the shaft 144 for driving the gear pulley 70 and the outer member of the one-way clutch 72 through the belt 173, and thereby the inner member of the one-way clutch 72 to normally drive the control drive shaft 58 on which the one-way clutch is mounted at a first speed determined by the number of teeth on the pulleys 156 and 70.

Another pulley 188 is mounted on the shaft 144 and is fastened to a first part of a disc or face clutch 148 having a second part controlled by air fed through a conduit 194. The clutch 148 is conventional and is similar to the clutch 48 except rather than having teeth for coupling the two parts together it has friction faced discs and may therefore be actuated while the shaft 144 is rotating. When actuated by air the discs of the clutch 148 engage and couple and thereby couple the pulley 188 to the shaft 144. Mounted fast on the shaft 58 is another gear pulley 174 and a gear belt 190 is trained about this pulley and the pulley 188. The drive ratios of the pulleys 174 and 188 is such that when pulley 174 is driven it drives the shaft 58 at a faster speed than the pulley 70. Thus, the outer member of the one-way clutch 72 then free wheels relative to the inner member.

Consequently, by connecting the conduit 194 to a control system such as the valves 98 and 100 and cam 96 illustrated in FIG. 4, the clutch 148 may be actuated in accordance with a pattern, thereby driving the shaft 58 and pulley 64 at two different speeds selectively. The pulley 64 may drive the feed rollers 28, 30 and 29, 31 in a manner similar to that illustrated in FIG. 4, and the backing material is fed accordingly. Whenever the backing material speed is increased the length of the backstitches is increased to provide less stitches per inch and a fabric may be produced having a variation in density. The effect of a small change in stitch length from e.g., 12 stitches per inch to 16 stitches per inch has provided a uniquely aesthetic pattern in the fabric. In fact, even with a single color yarn an effect can be obtained such that tufts in the areas of the longer backstitch appear to be a lighter shade of the color than the shorter backstitches.

Another aspect of the invention is the provision of apparatus for obtaining a tufted fabric having a pattern including more than one stitch length, such as that formed by the aforesaid second aspect as illustrated in FIG. 9, and also having a substantially elongated backing stitch relative to the other stitches periodically selectively disposed in the pattern such as that formed by the first aspect as illustrated in FIG. 4. To this end the invention provides a combination of the structure for obtaining the multiple stitch length illustrated in FIG. 9 and the controlled gap illustrated in FIG. 4. Thus, referring to FIG. 10 wherein the same reference numerals are applied to the equivalent structure of FIGS. 4 and 9, the additional gear pulley 188 and disc or face clutch 148 are mounted on the input shaft 44 of the intermittent drive 42. Moreover, the gear pulley 174 is fastened to the control shaft 58 and selectively driven by the pulley 188 through the tooth belt 190 which is trained about the pulleys 188 and 174. Hence, two different stitch lengths in addition to a substantially elongated stitch may be formed by this apparatus. The fabric thus has two different density tufts and a gap selectively formed therein. Of course, it should be understood that additional clutch and pulleys similar to 148, 188 and 174 may be provided if additional stitch lengths are desirable in the pattern.

To selectively control the tooth clutch 48 and each face clutch 148 according to a desired pattern, apparatus similar to the cam actuated valving means described in connection with FIG. 4 may be utilized for each air actuated clutch or a single system having a complex cam for controlling one set of valves may be utilized to feed air selectively to the conduits 94, 194. If two separate systems are used the timing must be such that no two clutches are driving at the same time for obvious reasons. The operation of this apparatus is the same as that heretofore described in conjunction with FIGS. 4 and 9, i.e., one of the pulleys 70, 174 or 74 may selectively drive the shaft 58 and thus the feed rollers 28, 30 and 29, 31. Because different shades of the same color can be produced by the pulleys 70 and 174, by selective threading of the needles and by selective elongated stitches provided by the pulley 74, it is possible to produce tufted plaid effects without subsequent printing, especially if the backing material is a different color than the yarn.

Figure 10:
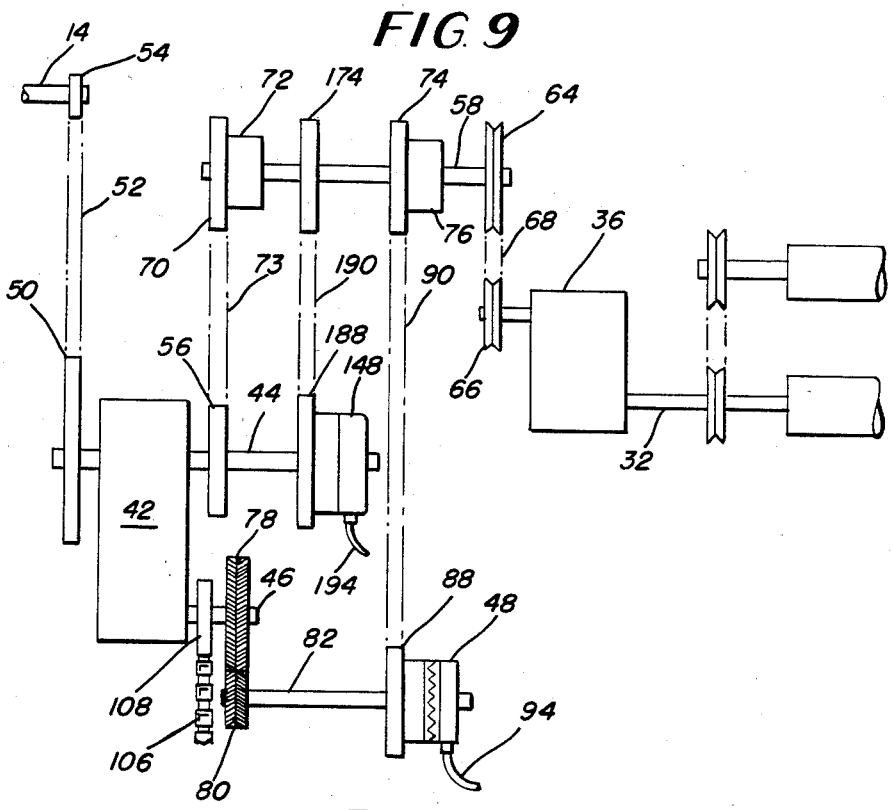
FIG. 10 is a diagrammatic view similar to FIG. 4 but illustrating a third aspect of the invention.
Figure 11:
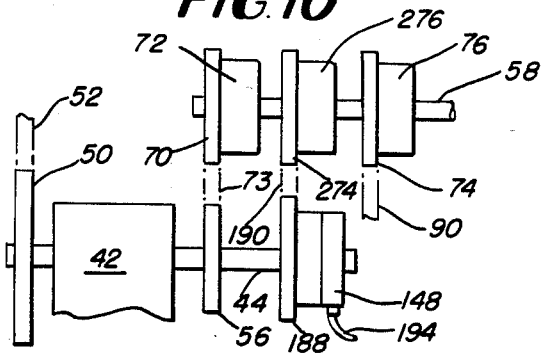
FIG. 11 is a diagrammatic view a portion of another embodiment of the apparatus illustrated in FIG. 10.

A modified embodiment of the combination variable stitch rate and elongated stitch structure described is illustrated in FIG. 11 which discloses only that portion of the structure of FIG. 10 which is modified. In this embodiment an additional one-way clutch 276 is mounted on the shaft 58 and cooperates with a pulley 274 driven from the pulley 188. The remaining structure is identical to that disclosed in FIG. 10. Since th speed at which the respective pulley 70, 274, 74 is progressively higher, two of the clutches 72, 276, 76 will slip when the third clutch is driving. For example, when neither pattern controlled clutch 48, 148 is engaged the shaft 58 is driven by the pulley 70 and clutch 72 while the other one-way clutchs 276, 76 and the respective pulleys 274, 74 slip. When either of the controlled clutches are actuated the respective one-way clutch 276 or 76 drives the shaft 58 while the other one-way clutches slip.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. In the method of forming a tufted pile fabric by a tufting machine having a bank of yarn carrying needles reciprocably driven by a rotating main shaft, and feed means including a control shaft drivably connected to said main shaft for feeding a backing material in a longitudinal direction for penetration thereof by the needles to insert longitudinal rows of successive yarn tufts therein, said tufts projecting from one surface of said backing and connected in each row by backstitches on the opposite surface of said backing, the improvement comprising, rotating said control shaft at a first rate for feeding the backing material through the machine at a first speed while forming tufted pile having a backstitch of a first length, and selectively increasing the rotational rate of the control shaft to increase the backing material feeding speed to a second speed to form a tufted pile having a backstitch longer than said first length.

2. In the method as recited in claim 1, wherein the feeding speed of said backing material is increased according to a periodic sequence.

3. In the method of forming tufted fabric as recited in claim 1, wherein said second speed may only occur after a fixed number of backstitches of said first length.

4. In the method of forming tufted fabric as recited in claim 3, wherein backstitches of said first length are selectively formed in lieu of backstitches of elongated length in accordance with a pattern.

5. In the method of forming tufted fabric as recited in claim 1, including selectively increasing the feeding rate to a third speed intermediate said first and second speed to form tufts having a backstitch of a third length, and wherein said second speed may only occur after a fixed number of backstitches of at least one of said first and third lengths.

6. In the method as recited in claim 5, wherein backstitches of at least one of said first and third lengths are selectively formed in lieu of backstitches of elongated length in accordance with a pattern.

7. In a tufting machine including a bank of laterally spaced yarn carrying needles, means including a rotatable main shaft for reciprocably driving said needles, means for supporting a backing material for penetration by said needles for insertion of a series of tufts of yarn into the backing material upon each penetration thereof, a control shaft, means for operatively driving said control shaft by said main shaft, feed means for feeding the backing material longitudinally through the tufting machine, means for driving said feed means by said control shaft for feeding said backing at a first speed in timed relationship with the needles to form tufts connected by a backstitch of a first length, and means for periodically selectively increasing the speed of said control shaft for increasing the feed rate of the backing material to a second speed in timed relationship with the needles to form tufts connected by a backstitch of a second length elongated relative to said first length.

8. In a tufting machine as recited in claim 7, wherein said means for periodically selectively increasing the speed of the control shaft comprises an intermittent drive having an input means continuously driveable through a repetitive cycle and output means driven by the input means during only an index portion of the cycle of the input means and being stationary during the remainder of the cycle of the input means, and means for driving the control shaft at a speed corresponding to the first speed when the output means is stationary and for driving the control shaft at a speed corresponding to the second speed when the output means is driven.

9. In a tufting machine as recited in claim 8, including pattern means for selectively precluding the feeding of the backing material at the second speed while maintaining the feeding of the backing material at the first speed.

10. In a tufting machine as recited in claim 7, including means for selectively driving the control shaft at a speed for feeding said backing at a third speed intermediate said first and second speeds and operable to form a backstitch longer than said first length.

11. In a tufting machine including a bank of laterally spaced yarn carrying needles, means including a rotatable main shaft for reciprocably driving said needles, means for supporting a backing material for penetration by said needles for insertion of a series of tufts of yarn into the backing material upon each penetration thereof, a control shaft, means for operatively driving said control shaft by said main shaft, rotatable feed rollers for feeding the backing material at a feed rate dependent upon the rotational speed of the rollers, means connecting said control shaft to said feed rollers for rotating the feed rollers at a first speed in timed relationship with the needles to form tufts connected by a backstitch of a first length, and means for periodically increasing the speed of the control shaft for increasing the rotational speed of the rollers to a second speed in timed relationship with the needles to form tufts connected by a backstitch of a second length elongated relative to said first length.

12. In a tufting machine as recited in claim 11, wherein said means for periodically increasing the speed of the control shaft comprises an intermittent drive having an input shaft continuously driveable through a repetitive cycle and an output shaft driven by the input shaft during only an index portion of the cycle of the input shaft and being stationary during the remainder of the cycle of the input shaft, an input drive train and an output drive train, the input shaft being operatively connected to the input drive train and the output shaft being operatively connected to the output drive train, said means for operatively driving said control shaft for rotating the feed rollers at said first speed including means for coupling the input drive train to the control shaft for driving the feed rollers at the first speed when the output shaft is not driven, and clutch means for uncoupling the control shaft from the input drive train and for coupling the output drive train to the control shaft for driving the feed rollers at the second speed when the output shaft is driven.

13. In a tufting machine as recited in claim 12, wherein said clutch means includes a pattern control means for selectively precluding coupling of the output drive train to the control shaft and maintaining the coupling of the input drive train to the control shaft to selectively preclude formation of tufts having said second length.

14. In a tufting machine including a bank of laterally spaced yarn carrying needles, means for reciprocably driving said needles, means for supporting a backing material for penetration by said needles for insertion of a row of tufts of yarn into the backing material upon each penetration thereof, the tufts formed by each needle being connected by a backstitch, and rotatable feed rollers for feeding the backing material at a speed dependent upon the rotational speed of the rollers, apparatus for periodically selectively increasing the speed of the feed rollers from a first speed in timed relationship with the needles to a second speed in timed relationship with the needles to increase the length of the backstitch from at least a first length to a second length, said apparatus comprising a drive shaft journally mounted for rotation, means for drivingly connecting the drive shaft to the feed rollers for rotating the feed rollers at a speed dependent upon the rotational speed of the drive shaft, an intermittent drive having a rotatable input shaft and output shaft, said output shaft being periodically rotatably driven during only an index portion of the rotational cycle of the input shaft and being stationary during the remainder of the cycle of the input shaft, means for rotatably driving the input shaft in timed relationship with the needles, first drive means for rotatably driving said drive shaft at a speed directly related to the rotational speed of said input shaft, first coupling means for normally coupling said first drive means to said drive shaft and for uncoupling said first drive means from said drive shaft when said drive shaft is driven at a speed greater than the speed driven by said first drive means, second drive means operatively connected to said output shaft for rotatably driving said drive shaft at a speed greater than the speed driven by said first drive means, second coupling means for coupling said second drive means to said drive shaft when said output shaft is driven and for uncoupling said second drive means from said drive shaft when said output shaft is not driven, and pattern control means for selectively uncoupling said driven shaft from said second drive means.

15. In a tufting machine as recited in claim 14, wherein said second drive means includes a control shaft journally mounted for rotation, means for drivingly connecting the control shaft to said output shaft for rotation therewith, a rotatably driveable member disposed on said control shaft, said pattern control means including pattern actuated clutch means mounted on said control shaft for selectively fastening and unfastening said rotatably driveable member with said control shaft.

16. In a tufting machine as recited in claim 14, wherein said first and second coupling means comprise one-way clutches disposed on said drive shaft and operatively connected to said drive shaft and to said first and second drive means respectively.

17. In a tufting machine as recited in claim 16, wherein said second drive means includes a control shaft journally mounted for rotation, means for drivingly connecting the control shaft to said output shaft for rotation therewith, a rotatably driveable member disposed on said control shaft, said pattern control means including pattern actuated clutch means mounted on said control shaft for selectively fastening and unfastening said rotatably driveable member with said control shaft.

18. In a tufting machine as recited in claim 17, wherein said pattern actuated clutch means comprises an air operated clutch, and means for supplying air selectively to said air operated clutch in accordance with a pattern.

19. In a tufting machine as recited in claim 17, wherein said first drive means includes a first pair of motion transmitting members, one member of said pair being operatively mounted on said input shaft and the other member of said pair being supported on said drive shaft and operatively connected to a respective one-way clutch, said second drive means including a second pair of motion transmitting members, said driveable member comprising one member of said second pair, the other member of said second pair being operatively connected to the other of said one-way clutches.

20. In a tufting machine as recited in claim 19, wherein said pattern actuated clutch means comprises an air operated clutch, and means for supplying air selectively to said air operated clutch in accordance with a pattern.

* * * * *